US009296249B2

(12) United States Patent
Zanova

(10) Patent No.: US 9,296,249 B2
(45) Date of Patent: Mar. 29, 2016

(54) MULTICOLOR WRITING AND DESIGNING MEANS

(71) Applicants: Chartpak, Inc., Melville, NY (US); Koh-I-Noor Hardtmuch A.S., Ceske Budejovice (CZ)

(72) Inventor: Zdenka Zanova, Lisov (CZ)

(73) Assignees: Chartpak, Inc., Melville, NY (US); Koh-I-Noor Hardmuth A.S., Ceske Budejovice (CZ)

( * ) Notice: Subject to any disclaimer, the term of this patent is extended or adjusted under 35 U.S.C. 154(b) by 140 days.

(21) Appl. No.: 13/738,334

(22) Filed: Jan. 10, 2013

(65) Prior Publication Data

US 2013/0189015 A1 Jul. 25, 2013

(30) Foreign Application Priority Data

Jan. 20, 2012 (CZ) ..... CZ2012-25500 U

(51) Int. Cl.
*B43K 19/02* (2006.01)
*B43K 19/18* (2006.01)
*B43K 27/04* (2006.01)

(52) U.S. Cl.
CPC ..... *B43K 19/02* (2013.01); *B43K 19/18* (2013.01); *B43K 27/04* (2013.01)

(58) Field of Classification Search
CPC ..... B43K 27/04
USPC ..... 401/34, 35, 49, 52
See application file for complete search history.

(56) References Cited

U.S. PATENT DOCUMENTS

| | | | | |
|---|---|---|---|---|
| 2,130,011 | A * | 9/1938 | Hersinhod | 401/29 |
| 5,388,924 | A * | 2/1995 | Chao | 401/35 |
| 6,877,922 | B2 * | 4/2005 | Ahmed | 401/35 |
| 7,845,872 | B2 * | 12/2010 | Mesalic | 401/35 |
| 2002/0197092 | A1 * | 12/2002 | Iosilevich | 401/52 |
| 2009/0016798 | A1 * | 1/2009 | Dunn-Rankin | 401/34 |
| 2012/0275840 | A1 * | 11/2012 | Liu | 401/35 |

* cited by examiner

*Primary Examiner* — David Walczak
*Assistant Examiner* — Joshua Wiljanen
(74) *Attorney, Agent, or Firm* — Myers Wolin, LLC

(57) ABSTRACT

A multicolor writing and designing device has an elongated pastel color capsule with a plurality of longitudinal segment groups disposed substantially in parallel with a main capsule axis, at least one segment of a group being located within the capsule such that it forms a capsule tip. At least two of the segment groups are of different tints from the same color sampling zone in a color space colorimetric triangle. having a plurality of such sampling zones. The color sampling zones may correspond to areas in the CIE 1964 10° Standard Observer color space.

2 Claims, 3 Drawing Sheets

MULTICOLOR WRITING AND DESIGNING MEANS

TECHNICAL FIELD OF THE INVENTION

The present invention relates to a multicolor writing and designing means or device containing a cylindrical multicolor pastel capsule composed of longitudinal color segments disposed substantially in parallel with the capsule axis and with the axis of a set of said means.

BACKGROUND OF THE INVENTION

Color pastel writing and designing means or devices containing pastel cores are known both in conventional wood coated form and in mechanical systems with extendable color capsules. Such color pastel writing and designing devices usually contain a pastel color stick of one color and of only one color intensity, tint or shade. Known from patent application DE 30 06 684 are also multicolor pastel cores in which the color deposited varies depending on the capsule inclination angle. Document CZ UV 16234 describes a multicolor writing means containing a capsule comprising different colors.

In the drawing and designing practices it is frequently required to emphasize various particular color tints—shades of the same color. Conventionally this is usually addressed by using a set of separate coloring means, each containing a different color shade of a color. Such a solution is hardly practicable in application, as the designer is obliged to use another means for each color tint or shade, and thus results in the necessity of using a considerably high number of such means in one set. This is especially impractical if a coloring set is to be used by an artist or as a school working item.

BRIEF DESCRIPTION OF THE INVENTION

The disadvantage of the present state of the art is avoided by the present invention, a multicolor writing and designing device with a cylindrical pastel capsule having longitudinal color segments disposed substantially parallel with the capsule axis, wherein at least one of the segments is incorporated inside of the pastel capsule without engaging with the lateral surface of the capsule shell, but emerging in the zone of its tip. The principle of the technical solution is in that the capsule is composed of various segments with different tints such that at least two of the color segments of the capsule belong to one of a set of separate color areas or zones in a colormetric triangle. In a preferred embodiment, the color areas or zones from which the tints are chosen may be six in number, as illustrated in FIG. 3 as color space areas or zones A, B, C, D, E and F. The segments may preferably have a square form in cross-section and are arranged in the cylindrical capsule in a chess-board pattern in regular alternation of individual color shades.

An advantage of such a construction is in that during drawing motions regularly alternating fields of individual color segments result, so that a line is drawn by several drawn traces composed of similar color tones or their combinations resulting from overlapping traces in a way that could hardly be obtained if other means are used.

A collection of such writing and designing devices can be formulated as a set of three or more such devices, each having a different main color. The artist or designer, while choosing the specific device that represents the basic color desired, is able to apply varying tints or shades of the chosen color, providing effects and shading variations, difficult if not impossible to otherwise lay down in a simple and efficient manner. In a preferred embodiment such a set may contain such devices in which at least two of the segments in a device are in the same one of the sampling color zones (A, B, C, D, E or F) in the colorimetric triangle, each of the devices of the set corresponding to a different zone, the zones themselves defining yellow, red, blue, green, brown and grey color ranges or tints in a color space.

BRIEF DESCRIPTION OF THE DRAWINGS

The present invention and technical solution is explained in more details in the following drawings, in which.

EXEMPLARY EMBODIMENT OF THE INVENTION

Figure 1:
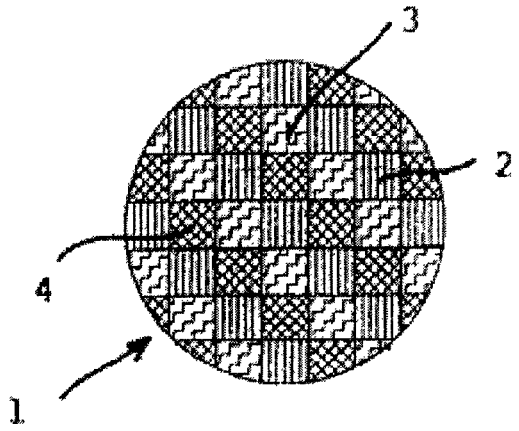
FIG. 1 shows a cross-section of the multicolor writing and designing means.
Figure 2:
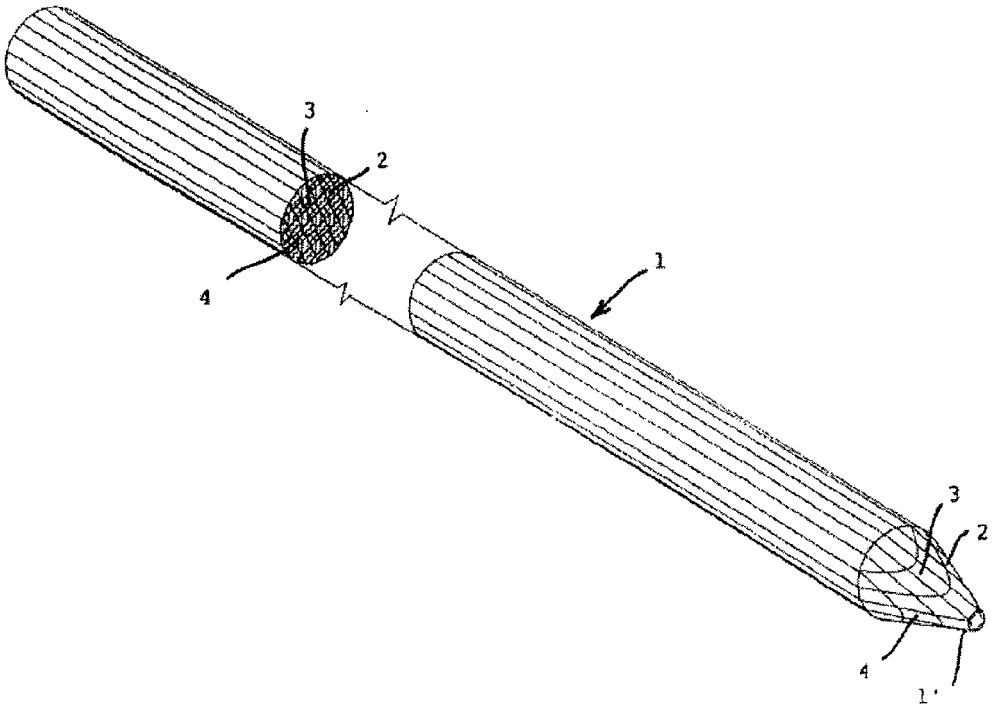
FIG. 2 is an axonometric view of a capsule core in a final configuration before being enclosed in a shell.

With reference to FIGS. 1 and 2, a multicolor writing and designing means of the invention may consists of a pastel color capsule I with a wood coating. A series of longitudinal color segments 2, 3 and 4, square in cross-section, are arrayed in a regular alternating manner to form the capsule 1. As shown, the segments may form a regular repeating pattern across the capsule. As known, the longitudinal color segments 2, 3 and 4 may be of any acceptable pigment and binder compositions as known in the art. At least two of the different longitudinal color segments 2, 3, 4 are of different shades or tints of the same color and each disposed substantially in parallel with the longitudinal axis of capsule 1. A forward end of the capsule is tapered to a tip 1', such that at least one of the segments is arranged inside of the pastel capsule so that it emerges at the tip.

Figure 3:
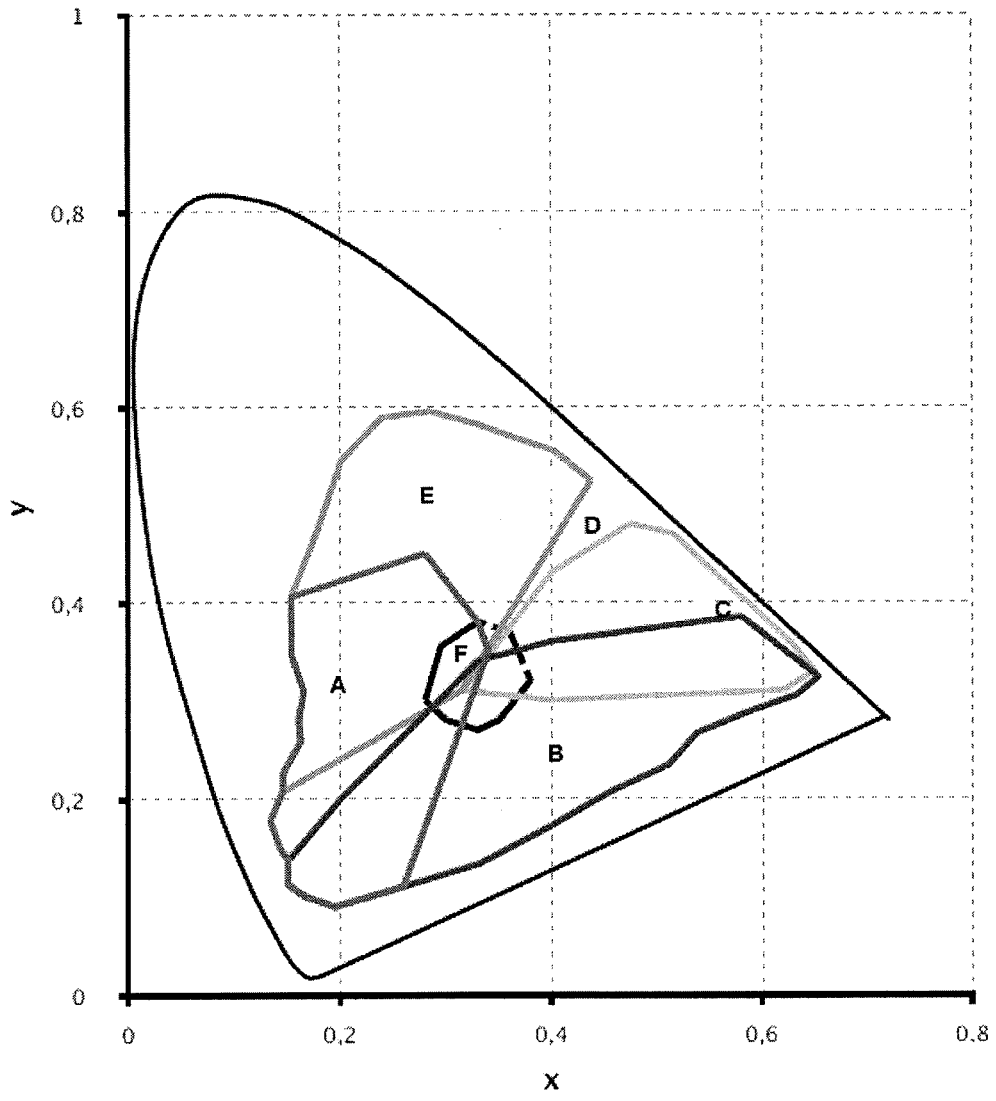
FIG. 3 is a graphical presentation of sampling color zones and their marginal values expressed in x, y values in a colorimetric triangle.

Each of the segments 2, 3, 4 is of a particular tint or shade of a color area or zone as defined by the area of one of the six sampling zone colors A, B, C, D, E and F as presented in the colorimetric triangle shown in FIG. 3. In the present embodiment the color segments 2, 3, 4 of the multicolor writing and designing means capsule according to the present technical solution are composed would be, for example, of various tints of green, corresponding to zone or area E in the graph.

The following Table 1 presents a tabulation of loci setting forth marginal values establishing the perimeters of the color sampling zones segments expressed by the x, y values in the colorimetric triangle. The colormetric triangle is the CIE 1964 10° Standard Observer color space.

TABLE 1

| A | | B | | C | | D | | E | | F | |
|---|---|---|---|---|---|---|---|---|---|---|---|
| x | y | x | y | x | y | x | y | x | y | x | y |
| 0.2800 | 0.4500 | 0.1503 | 0.1373 | 0.6200 | 0.3100 | 0.4100 | 0.5500 | 0.4380 | 0,.241 | 0.2800 | 0.3000 |
| 0.1529 | 0.4055 | 0,.502 | 0.1128 | 0.6500 | 0.3300 | 0.5159 | 0.4700 | 0.4031 | 0.5547 | 0.3000 | 0.2800 |

TABLE 1-continued

| A | | B | | C | | D | | E | | F | |
|---|---|---|---|---|---|---|---|---|---|---|---|
| x | y | x | y | x | y | x | y | x | y | x | y |
| 0.1535 | 0.3462 | 0.1669 | 0.1005 | 0.6279 | 0.3585 | 0.5500 | 0.4352 | 0.3661 | 0.5679 | 0.3300 | 0.2700 |
| 0.1651 | 0.3096 | 0.1949 | 0.0902 | 0.5872 | 0.3987 | 0.5700 | 0.4100 | 0.3274 | 0.5830 | 0.3500 | 0.2800 |
| 0.1605 | 0.2801 | 0.2592 | 0.1107 | 0.5500 | 0.4352 | 0.3150 | 0.3100 | 0.2845 | 0.5950 | 0.3800 | 0.3200 |
| 0.1624 | 0.2588 | 0.3313 | 0.1339 | 0.5159 | 0.4700 | 0.3500 | 0.4000 | 0.2395 | 0.5891 | 0.3600 | 0.3700 |
| 0.1456 | 0.2267 | 0.4001 | 0.1726 | 0.4750 | 0.4800 | | | 0.2009 | 0.5452 | 0.3300 | 0.3800 |
| 0.1448 | 0.2072 | 0.4562 | 0.2073 | 0.4000 | 0.4300 | | | 0.1773 | 0.4702 | 0.2950 | 0.3550 |
| 0.1333 | 0.1781 | 0.5108 | 0.2342 | 0.3150 | 0.3100 | | | 0.1529 | 0.4055 | | |
| 0.1425 | 0.1499 | 0.5390 | 0.2669 | 0.4000 | 0.3000 | | | 0.1535 | 0.3462 | | |
| 0.1503 | 0.1373 | 0.5864 | 0.2880 | | | | | 0.1651 | 0.3096 | | |
| 0.1502 | 0.1128 | 0.6329 | 0.3052 | | | | | 0.1605 | 0.2801 | | |
| 0.1669 | 0.1005 | 0.6537 | 0.3237 | | | | | 0.1624 | 0.2588 | | |
| 0.1949 | 0.0902 | 0.5800 | 0.3852 | | | | | 0.1456 | 0.2267 | | |
| 0.2592 | 0.1107 | 0.4000 | 0.3600 | | | | | 0.1448 | 0.2072 | | |
| 0.2600 | 0.1100 | 0.3300 | 0.3400 | | | | | 0.3150 | 0.3100 | | |
| 0.3400 | 0.3500 | 0.2000 | 0.2000 | | | | | | | | |
| 0.3300 | 0.3800 | | | | | | | | | | |

In addition to each of the segment groups 2, 3 and 4 being a different tint or shade of the same color as expressed within a zone A-F, the capsule may contain two or more segments of different tints of the same color, and another segment group of a tint from another color zone. A kit or set of devices may have three to six individual devices, each designated to correspond to a different of the color zones A-F.

The multicolor writing and designing means or device according to the present invention can be used for writing, drawing and designing, and may be configured as a pastel color pencil for artists or children and/or as a marking instrument for writing security signatures. A set of such devices containing a basic or extended colour line can be used as a pastel pencil set.

The invention claimed is:

1. A multicolor writing and designing device having an elongated pastel color capsule comprising a plurality of longitudinal segment groups disposed substantially in parallel with a main capsule axis, at least one segment of a group being located within the capsule such that it forms a capsule tip, at least two of the segment groups being of different tints chosen from the same color sampling zone in a color space colorimetric triangle having a plurality of such sampling zones, and wherein the segments from different segment groups are arrayed in a regular alternating manner.

2. The multicolor writing and designing device of claim 1 wherein the segments from different segment groups form a regular repeating pattern.

* * * * *